US011012788B2

(12) United States Patent
Enenkl et al.

(10) Patent No.: US 11,012,788 B2
(45) Date of Patent: May 18, 2021

(54) LOUDSPEAKER SYSTEM

(71) Applicant: Sony Corporation, Tokyo (JP)

(72) Inventors: Michael Enenkl, Stuttgart (DE); Thomas Kemp, Stuttgart (DE); Patrick Putzolu, Stuttgart (DE); Stefan Uhlich, Stuttgart (DE)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/361,262

(22) Filed: Mar. 22, 2019

(65) Prior Publication Data

US 2019/0306631 A1 Oct. 3, 2019

(30) Foreign Application Priority Data

Mar. 27, 2018 (EP) ..... 18164181

(51) Int. Cl.

| | |
|---|---|
| ***H04R 19/02*** | (2006.01) |
| ***H04R 9/06*** | (2006.01) |
| ***H04R 9/02*** | (2006.01) |
| ***H04R 1/28*** | (2006.01) |
| ***H04R 1/24*** | (2006.01) |
| ***H04R 7/16*** | (2006.01) |
| ***H04R 1/02*** | (2006.01) |

(52) U.S. Cl.

CPC ..... *H04R 19/02* (2013.01); *H04R 1/02* (2013.01); *H04R 1/24* (2013.01); *H04R 1/2811* (2013.01); *H04R 7/16* (2013.01); *H04R 9/025* (2013.01); *H04R 9/06* (2013.01)

(58) Field of Classification Search

CPC ..... H04R 19/02; H04R 1/02; H04R 9/025; H04R 9/06; H04R 7/16; H04R 1/24; H04R 1/2811; H04R 23/02; H04R 7/122; H04R 9/02

See application file for complete search history.

(56) References Cited

U.S. PATENT DOCUMENTS

| | | | | | |
|---|---|---|---|---|---|
| 2,615,994 | A | * | 10/1952 | Lindenberg | H04R 19/02 381/191 |
| 2,855,467 | A | * | 10/1958 | Curry | H04R 19/02 381/191 |
| 2,922,851 | A | * | 1/1960 | Manley | H04R 23/02 381/186 |
| 2,993,097 | A | * | 7/1961 | Swift | H04R 1/26 381/191 |
| 3,345,469 | A | * | 10/1967 | Rod | H04R 19/02 381/191 |
| 3,943,304 | A | * | 3/1976 | Piribauer | H04R 1/24 381/99 |

(Continued)

FOREIGN PATENT DOCUMENTS

| | | |
|---|---|---|
| CN | 201312379 Y | 9/2009 |
| CN | 205051860 U | 2/2016 |

(Continued)

OTHER PUBLICATIONS

Audico, "Elan Elios E72D—7" In-Ceiling Dual Voice Coil Speaker Stationary Woofer—Each, 3 pages.

*Primary Examiner* — Oyesola C Ojo
(74) *Attorney, Agent, or Firm* — Xsensus LLP

(57) ABSTRACT

A loudspeaker system comprising a diaphragm (101) and an electrostatic foil (108) mounted on top of the diaphragm (101).

15 Claims, 10 Drawing Sheets

(56) References Cited

U.S. PATENT DOCUMENTS 4,122,302 A * 10/1978 Bobb ..... H04R 1/26 181/145
4,251,686 A * 2/1981 Sokolich ..... A61B 5/12 381/338
4,447,678 A * 5/1984 Fidi ..... H04R 23/02 181/153
5,212,732 A 5/1993 Hipps et al.
5,450,498 A * 9/1995 Whitehead ..... B06B 1/0292 381/174
5,689,093 A * 11/1997 Sun ..... H04R 7/20 181/157
6,175,636 B1 * 1/2001 Norris ..... H04R 19/02 381/163
6,393,129 B1 * 5/2002 Conrad ..... H04R 19/00 381/191
6,760,455 B2 * 7/2004 Croft, III ..... H04R 19/02 381/173
6,842,964 B1 * 1/2005 Tucker ..... H04R 19/00 29/592.1
7,024,014 B1 4/2006 Noll
8,130,994 B2 3/2012 Button et al.
8,290,197 B2 * 10/2012 Buining ..... H04R 19/02 381/394
8,565,454 B2 * 10/2013 Kelloniemi ..... H04R 19/00 381/191
8,807,268 B2 8/2014 Dodd
8,938,084 B2 1/2015 Arai
9,294,832 B2 3/2016 Suvanto et al.
9,596,544 B1 * 3/2017 Brotherton ..... H04R 19/02
10,362,405 B2 * 7/2019 Yoshinaga ..... H04R 7/04
2005/0147265 A1 * 7/2005 Smits ..... H04R 19/02 381/191
2007/0189559 A1 * 8/2007 Haan ..... H04R 19/02 381/191
2008/0118077 A1 * 5/2008 Rasmussen ..... A61B 5/055 381/71.3
2012/0148074 A1 * 6/2012 Bastiaens ..... H04R 19/02 381/191
2012/0237069 A1 * 9/2012 Harman ..... H04R 19/02 381/336
2013/0129121 A1 * 5/2013 Yamashita ..... H04R 31/00 381/191
2014/0133680 A1 * 5/2014 Lee ..... H04R 5/02 381/191

FOREIGN PATENT DOCUMENTS

DE 3603537 A1 8/1987
EP 334217 A2 9/1989
EP 1059830 A2 12/2000
JP 5846797 A 3/1983
JP 2013-031856 A 2/2013
JP 5213802 B2 6/2013
WO 96/29843 A1 9/1996
WO 03/030583 A2 4/2003
WO 2014/190423 A1 12/2014

* cited by examiner

LOUDSPEAKER SYSTEM

CROSS-REFERENCE TO RELATED APPLICATION

The present application claims priority to European Patent Application 18164181.2 filed by the European Patent Office on Mar. 27, 2018, the entire contents of which being incorporated herein by reference.

TECHNICAL FIELD

The present disclosure generally pertains to the technical field of acoustics, in particular to loudspeakers.

TECHNICAL BACKGROUND

Loudspeakers are technical devices which convert an electrical audio signal into a corresponding sound. The most widely used type of loudspeaker is the dynamic loudspeaker, in which sound is generated by a swinging diaphragm driven by an electromagnet, which oscillates in the external field of at least one permanent magnet. It uses a lightweight diaphragm, or cone, connected to a rigid basket, or frame, via a flexible suspension, commonly called a spider, that constrains a voice coil to move axially through a cylindrical magnetic gap. When an electrical signal is applied to the voice coil, a magnetic field is created by the electric current in the voice coil, making it a variable electromagnet. The coil and the driver's magnetic system interact, generating a mechanical force that causes the coil (and thus, the attached cone) to move back and forth, accelerating and reproducing sound under the control of the applied electrical signal coming from the amplifier.

There are also other technical concepts for realizing a loudspeaker. The most common alternative implementation of a loudspeaker is the electrostatic loudspeaker, in which not a magnet is used to drive the diaphragm, but the electrostatic Coulomb force is used. Those loudspeakers use a thin flat diaphragm usually consisting of a plastic sheet coated with a conductive material such as graphite near an electrically conductive grid, with a small air gap between the diaphragm and grid. The driving force is in contrast to a dynamic loudspeaker not the Lorentz Force but the electrostatic Coulomb-Force.

SUMMARY

According to an aspect of the disclosure, a loudspeaker system is provided comprising a diaphragm and an electrostatic foil mounted on top of the diaphragm. Further aspects are set forth in the dependent claims, the following description and the drawings.

BRIEF DESCRIPTION OF THE DRAWINGS

Embodiments are explained by way of example with respect to the accompanying drawings, in which.

DETAILED DESCRIPTION OF EMBODIMENTS

Figure 1:
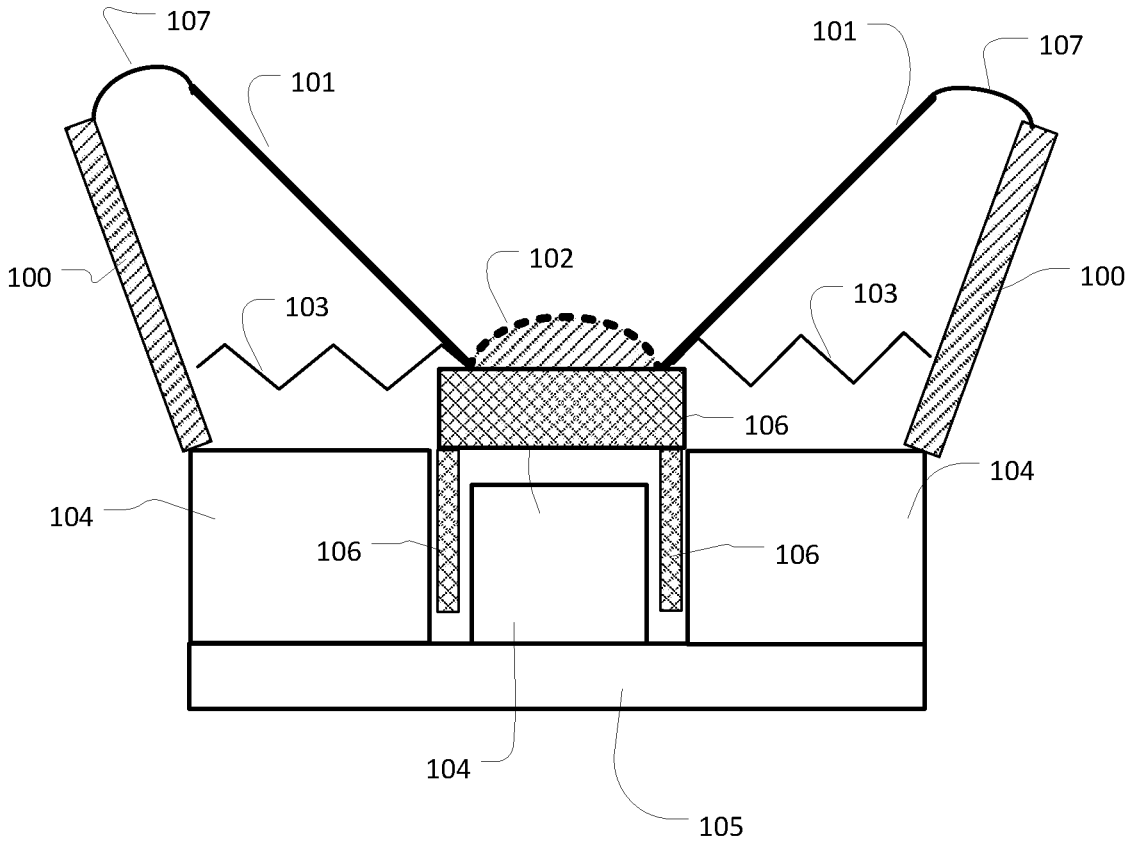
FIG. 1 shows the basic structure of a dynamic loudspeaker.

Before a detailed description of the embodiments under reference of FIG. 1, general explanations are made.

The embodiments describe a loudspeaker system comprising a diaphragm and an electrostatic foil mounted on top of the diaphragm.

The electrostatic foil may be configured to emphasize predefined frequencies or frequency ranges where modal resonances of the diaphragm occur. The electrostatic foil may for example be configured to compensate the power loss due to partial oscillations occurring on a dynamic loudspeaker's diaphragm.

The diaphragm may be magnetically driven according to the principle of a dynamic loudspeaker. That is, the diaphragm may be a diaphragm of a dynamic loudspeaker, and the dynamic loudspeaker may comprise at least one of the following: a loudspeaker basket, a dust cap, a spider, a permanent magnet, a bottom plate, a voice coil, and a surround.

According to the embodiments, the electrostatic foil acts as an electrostatic loudspeaker. The loudspeaker system thus may combine the functionality of an electrostatic and a dynamic loudspeaker to enhance a dynamic loudspeaker, e.g. in the high-frequency region. Dynamic loudspeakers may show a good performance in the low-frequency region until a natural frequency of the diaphragm. For frequencies larger than the natural frequency, partial oscillations may result on the diaphragm which leads to an output loss in radiation power of the dynamic loudspeaker leading to decreased volume for those frequencies. Also, electrostatic loudspeakers may have a good high-frequency performance, but a very bad performance for low-frequency and standing on its own the sound quality is very bad, as a not-preventable clangor sound occurs.

According to an embodiment, the electrostatic foil comprises a stator that is mounted on the diaphragm of the dynamic loudspeaker and an electrostatic diaphragm that is mounted above the stator with a gap, e.g. an air gap, between the stator and the electrostatic diaphragm. An electrostatic loudspeaker mounted on a dynamic loudspeaker's diaphragm may for example be constructed based on the single-ended electrostatic speaker design.

According to another embodiment, the electrostatic foil comprises an electrostatic diaphragm mounted above the diaphragm of the dynamic loudspeaker with a gap between the diaphragm and the electrostatic diaphragm, and the diaphragm of the dynamic loudspeaker is a conductive diaphragm that is used as a stator of an electrostatic loudspeaker.

According to some embodiments, the electrostatic foil mounted on the diaphragm of the dynamic loudspeaker is separated into a plurality of individual segments. Each such segment of the electrostatic foil may be configured as an electrostatic loudspeaker that is driven individually.

The loudspeaker system may further comprise a controlling device configured to drive the electrostatic foil, the controlling device comprising a frequency-shaping filter. The frequency-shaping filter may for example be a frequency-separating filter for driving the electrostatic loudspeaker.

The frequency-shaping filter may for example comprise a high-pass filter, the high-pass filter having a cutoff frequency related to a mode of the natural frequency of the diaphragm of the dynamic loudspeaker.

Alternatively or in addition, the frequency-shaping filter may comprise one or more band-pass filters, each band-pass filter having a central frequency around a respective mode of the natural frequency of the diaphragm of the dynamic loudspeaker.

The loudspeaker system may be used as a two-way loudspeaker. For example, the dynamic loudspeaker by means of the magnetically driven diaphragm may provide the low and mid frequencies, whereas the electrostatic loudspeaker system by means of the electrostatic diaphragm may provide the high frequencies. Thus, the layered loudspeaker systems may add up to one multi frequency system with uniaxial characteristics.

A measurement and analysis of the capacity of the electrostatic foil may be performed. By measurement of the capacity of the electrostatic foil, the deformation of the dynamic membrane can be analysed. Thus, parameters for the correction function may be derived.

The loudspeaker system may further comprise a first voice coil that drives the diaphragm and a second voice coil to which a DSP corrected signal is applied.

The loudspeaker system may further comprise means for measuring the capacity of the electrostatic foil. By measuring the capacity of the electrostatic foil the deformation of the dynamic membrane can be analysed and a recalibration of the device due to aging effects that change the properties of the dynamic membrane can be achieved based on in-situ measurements. This dynamic recalibration that allows to compensate for aging effects of the membrane Dynamic and Electrostatic Loudspeaker FIG. 1 shows the basic structure of a dynamic loudspeaker. A dynamic loudspeaker comprises a diaphragm 101 for sound generation which is fastened to a basket 100 with a dust cap 102. The diaphragm 101 may be a membrane. Basket 100 and dust cap 102 stabilize the loudspeaker and let the diaphragm oscillate in a firm frame. The diaphragm 101 is flexibly fastened to the basket 100 via a surround 107, which is a piece of elastic rubber, foam, or textile. The dust cap 102 is mounted on a voice coil 106 and both are fixed in horizontal direction by a spider 103, a flexible, corrugated support that holds the voice coil in place, while allowing it to move freely. The voice coil 106 is placed in the magnetic field of permanent magnets 104 typically made from ferrite or powerful neodymium. The permanent magnets 104 are mounted on a bottom plate 105 mostly made of soft iron.

The working principle of a dynamic loudspeaker is based on the Lorentz force $F_L$ $$\vec{F}_L = q \cdot \vec{v} \times \vec{B}$$

Driving an electrical signal (equals a current) through the voice coil 106 leads to the Lorentz force $F_L$ moving the voice coil back and forth as the signal current flows within the voice coil 106, which is placed in the extern magnetic field of the permanent magnets 104. Therefore the voice coil 106 moves synchronously to the signal current within. Synchronously to the voice coil 106 the diaphragm 101 moves producing sound as the air before (and behind) the diaphragm 101 is compressed/depressed.

Figure 2:
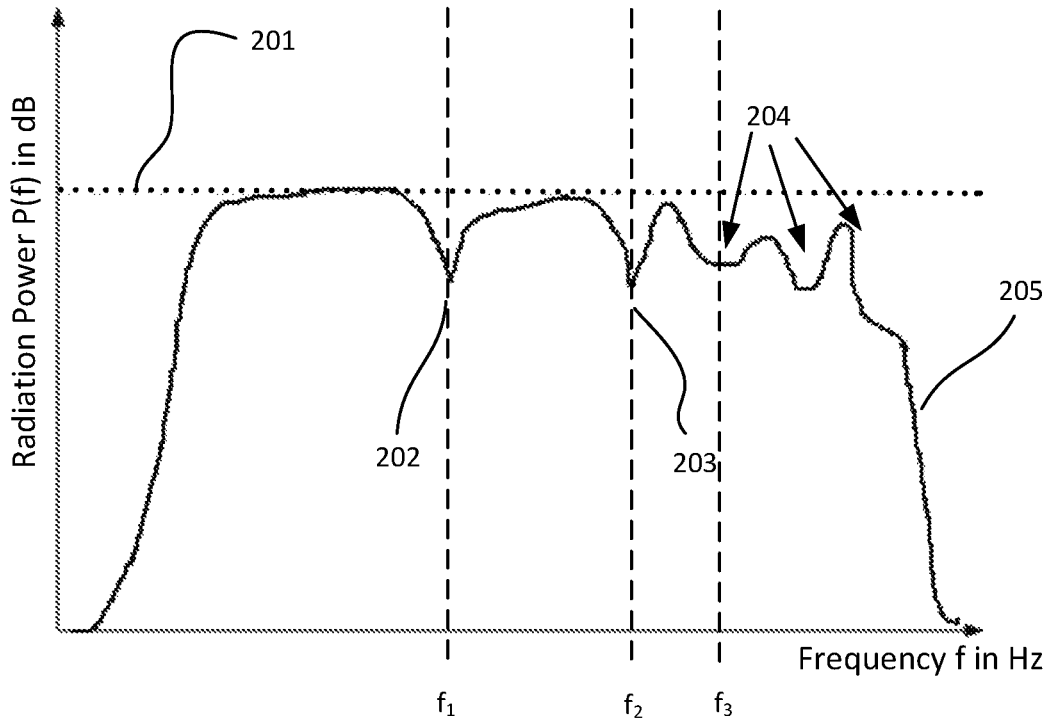
FIG. 2 visualizes the problem of partial oscillations, i.e. volume-/sound radiation power-loss due to destructive interference near to modes of the natural frequency of the loudspeakers diaphragm.
Figure 3:
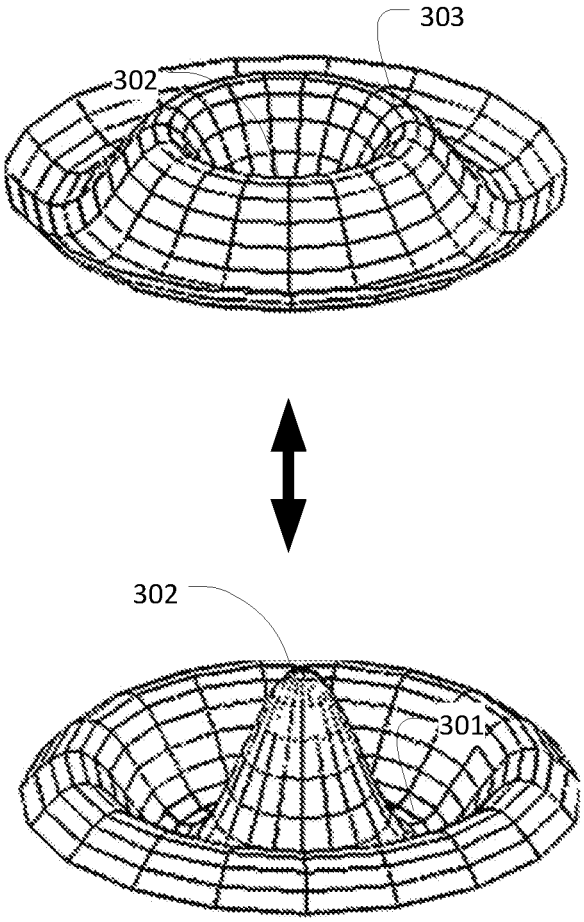
FIG. 3 visualizes the first partial oscillation mode $u_2$ on a diaphragm of a dynamic loudspeaker.

FIG. 2 visualizes the problem of partial oscillations, i.e. radiation power-loss due to destructive interference near to modes of the natural frequency of the loudspeakers diaphragm (deterioration in the volume and sound). The ideal line for the sound radiation power P(f) 201 in dB is printed as a dotted line, whilst the real course P(f) of a dynamic loudspeaker 205 is printed as a solid line. As the skilled person knows, the logarithm of the sound radiation power P(f) is proportional to the volume heard by a human user. The Fig. illustrates in a diagram how the Radiation Power P(f) in dB, depending on the frequency, is reduced for frequencies in the area around the modes of the natural frequencies $f_1$, $f_2$ and $f_3$ with minima 202, 203 of P(f) at $f_1$ and $f_2$ and a group of minima 204 for frequencies $\geq f_3$. This course 205 of P(f) in a real dynamic loudspeaker can be explained by partial oscillations. Partial oscillations shall further be explained by the example of the first partial oscillation mode $u_2$:

FIG. 3 visualizes the first partial oscillation mode $u_2$ on a diaphragm 101. Each diaphragm has several natural frequencies $f_N$. If the diaphragm is stirred with one of their natural frequencies, then the diaphragm starts to oscillate in this mode additionally to the extern oscillation, which is stirred by the voice coil 106. Both oscillations interfere on the diaphragm. This leads to destructive interference as the oscillating segments are slowed by the interfering partial oscillation modes. The driven oscillation by the voice coil 106 is equal to the movement/oscillation of the diaphragm's peak 301, while the partial oscillation leads to the negative deflection 302 of the segments in the middle of the diaphragm. When the peak is negatively deflected, the partial oscillation leads to a positive deflection 303. In sum this leads to a smaller volume of air that is moved, leading to a decreased sound pressure emitted, which results in a decrease in P(f) as visible in FIG. 2.

Figure 4:
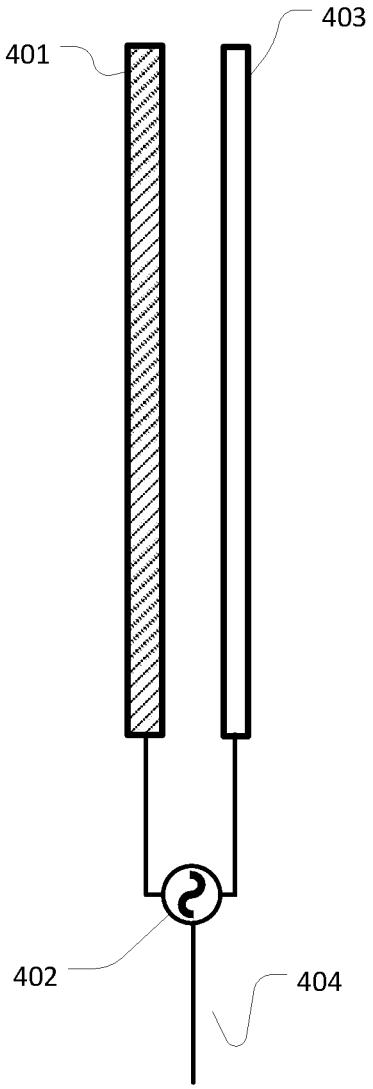
FIG. 4 shows the basic structure of an electrostatic loudspeaker.

FIG. 4 shows the basic structure of an electrostatic loudspeaker. This electrostatic loudspeaker is of the single-ended type and comprises a stator 401, a controlling device 402, a thin flat electrostatic diaphragm 403 and a signal line 404. The electrostatic diaphragm 403 consists of a plastic sheet coated with a conductive material such as graphite. A sound signal is transmitted through the signal line 404 to the controlling device 402, which processes the sound signal in an electric signal with a sufficient high amperage. This processing may include voltage transformation, current amplification, modulation or demodulation, etc. The electric signal is injected in the stator 401, which generates an oscillating electric field. The electrostatic diaphragm 403 is electrostatically charged, such that the oscillating electric field in the stator 401 leads to a corresponding oscillation of the electrostatic diaphragm 403. The oscillating electrostatic diaphragm 403 moves air in front of and behind the diaphragm. This leads to a sound emitted by the electrostatic loudspeaker.

Dynamic Loudspeaker with Modal Correction of Loudspeaker Membranes

Figure 5:
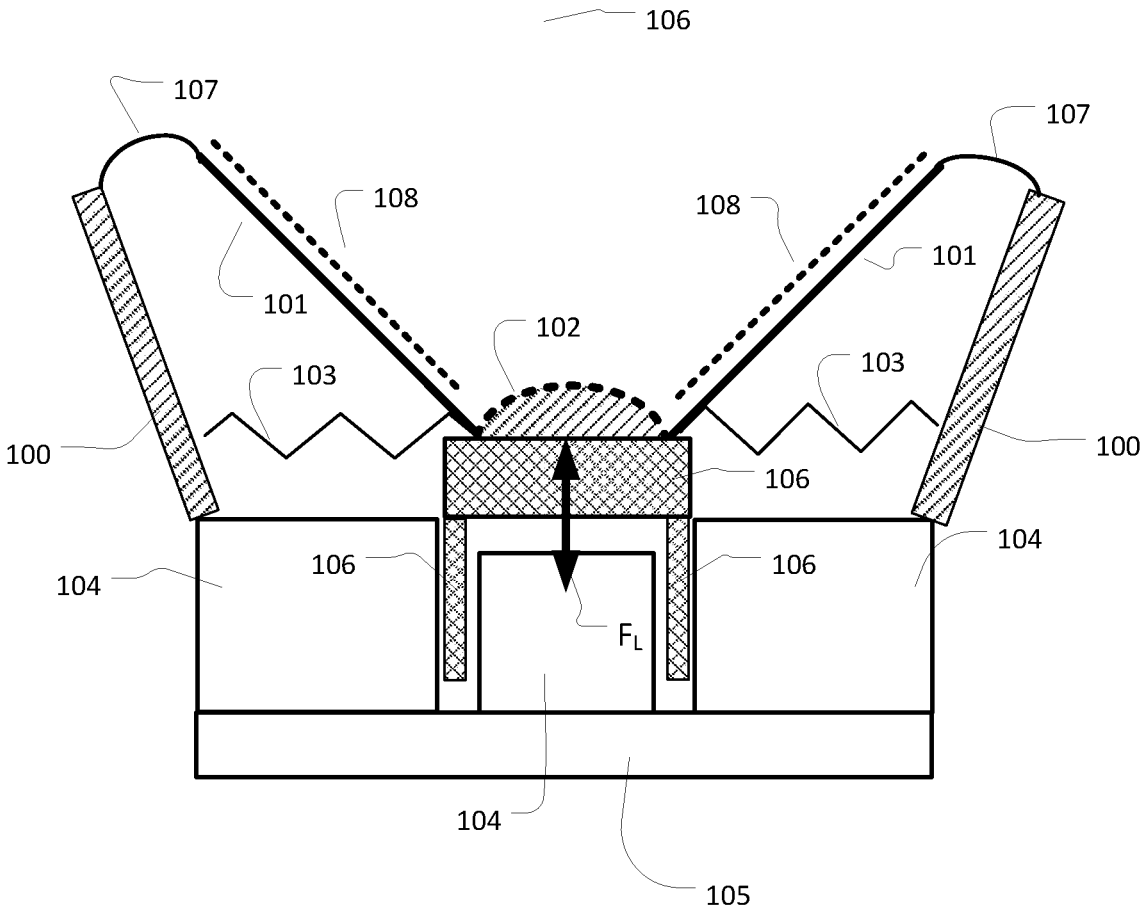
FIG. 5 shows an example of a loudspeaker with modal correction of the loudspeaker membrane.

FIG. 5 shows an example of a loudspeaker with modal correction of the loudspeaker membrane. An electrostatic loudspeaker is mounted on the diaphragm of the loudspeaker. The realization of the loudspeaker is similar to the dynamic loudspeaker shown in FIG. 1. A diaphragm 101 for sound generation is fastened to a basket 100 with a dust cap 102. Basket 100 and dust cap 102 stabilize the loudspeaker and let the diaphragm oscillate in a firm frame. The diaphragm 101 is flexibly fastened to the basket 100 via a surround 107, which is a piece of elastic rubber, foam, or textile. The dust cap 102 is mounted on a voice coil 106 and both are fixed in horizontal direction by a spider 103, a flexible, corrugated support that holds the voice coil in place, while allowing it to move freely. The voice coil 106 is placed in the magnetic field of permanent magnets 104 typically made from ferrite or powerful neodymium. The permanent magnets 104 are mounted on a bottom plate 105 mostly made of soft iron.

An electrostatic foil 108 is mounted on the diaphragm 101 of the dynamic loudspeaker. The electrostatic foil 108 has electrical contacts (see FIGS. 6*a*, 6*b*), where a driving signal (e.g. a voltage) can be applied, which turns the electrostatic foil 108 into an electrostatic loudspeaker. This electrostatic loudspeaker can be driven separately from the diaphragm 101 of the dynamic, loudspeaker such that the electrostatic foil 108 can compensate deteriorations caused by modal resonances (e.g. partial oscillations) of the diaphragm membrane 101.

Figure 6A:
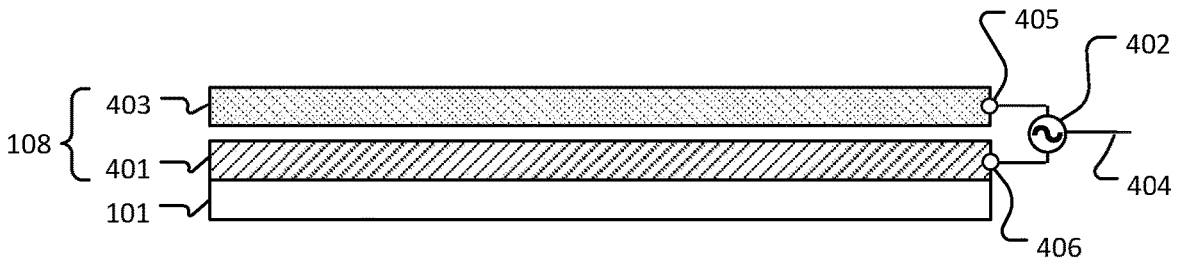
FIGS. 6*a* and 6*b* show two examples of an electrostatic foil mounted on the diaphragm of a dynamic loudspeaker.

FIG. 6*a* shows an embodiment of an electrostatic foil 108 mounted on a diaphragm 101 of a dynamic loudspeaker. The electrostatic foil 108 comprises a stator 401 and a electrostatic diaphragm 403. The stator 401 is directly mounted on the diaphragm 101 of the dynamic loudspeaker. A small air gap is provided between stator 401 and electrostatic diaphragm 403. The electrostatic diaphragm 403 may consist of a plastic sheet coated with a conductive material such as graphite. Stator 401 and electrostatic diaphragm 403 comprise contacts 405, 406 for applying an electrical signal and they are driven by a controlling unit 402 which is accessed by a signal line 404.

Figure 6B:
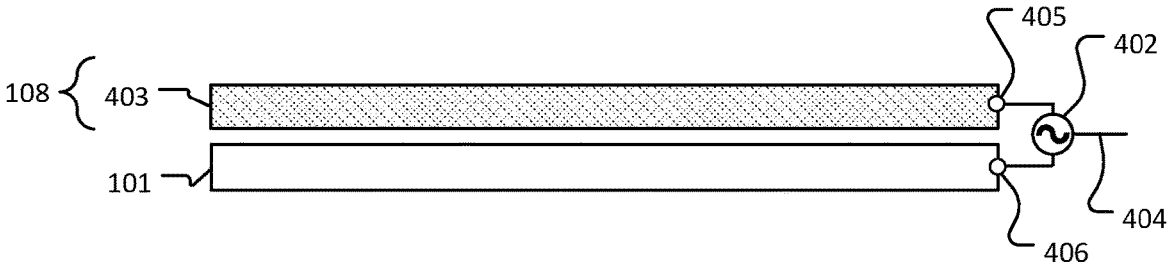

FIG. 6*b* shows a further embodiment of an electrostatic foil 108 mounted on a diaphragm 101 of a dynamic loudspeaker. The electrostatic foil 108 comprises an electrostatic diaphragm 403. The electrostatic diaphragm 403 may consist of a plastic sheet coated with a conductive material such as graphite. In this embodiment, the diaphragm 101 of the dynamic loudspeaker is configured to act as stator of an electrostatic loudspeaker loudspeaker. For example, like the electrostatic diaphragm 403, the diaphragm 101 of the dynamic loudspeaker may consist of a plastic sheet coated with a conductive material such as graphite. The electrostatic diaphragm 403 and the diaphragm 101 of the dynamic loudspeaker form an electrostatic loudspeaker. The diaphragm 101 of the dynamic loudspeaker and the electrostatic diaphragm 403 of the electrostatic loudspeaker comprise contacts 405, 406 for applying an electrical signal and they are driven by a controlling unit 402 which is accessed by a signal line 404.

Figure 7A:
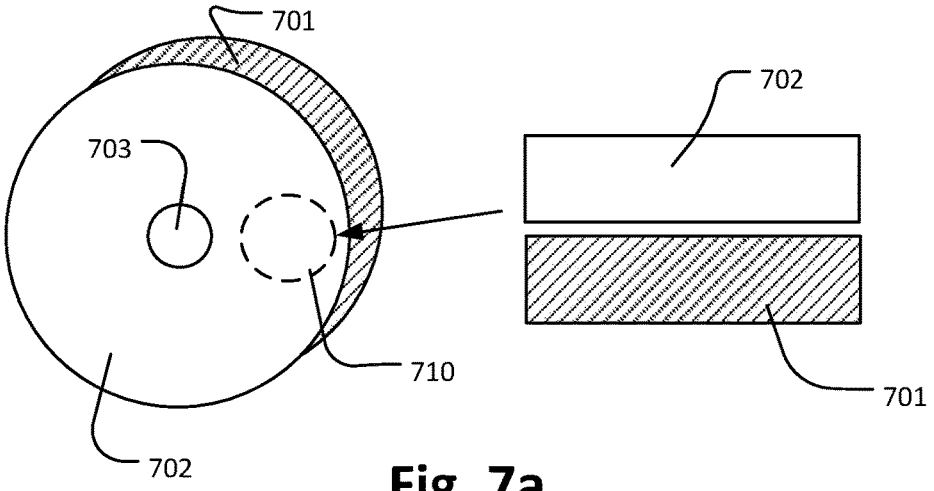
FIGS. 7*a, b* and *c* show three embodiments of segmenting the mounted electrostatic loudspeaker on a diaphragm of a dynamic loudspeaker.

FIGS. 7*a, b* and *c* show three embodiments of segmenting an electrostatic loudspeaker on a diaphragm of a dynamic loudspeaker.

FIG. 7*a* shows a dynamic diaphragm 701 with a dust cap 703 and an electrostatic loudspeaker 702 mounted on the dynamic diaphragm 701. The electrostatic loudspeaker 702 is structured as one single segment and may be an electrostatic foil such as described above with regard to FIGS. 6*a* and/or 6*b*. The detail view 710 shows this structure as a lateral cut.

Figure 7B:
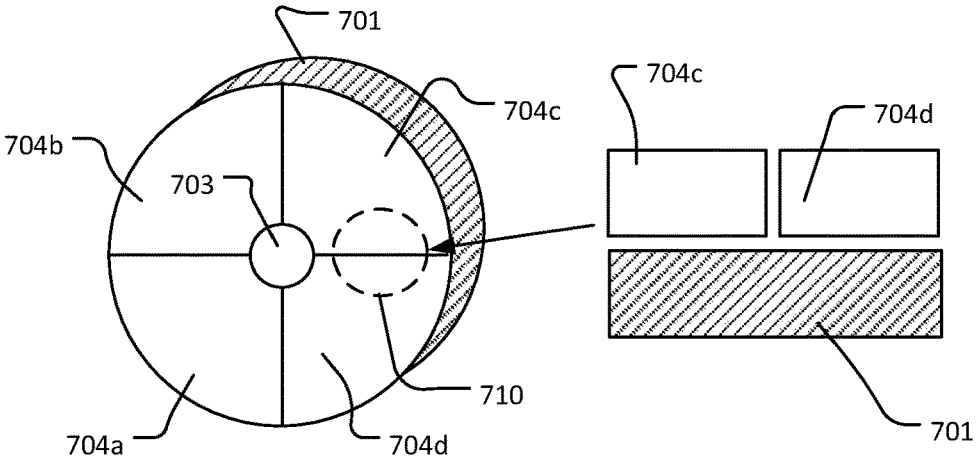

FIG. 7*b* shows a dynamic diaphragm 701 with a dust cap 703 and an electrostatic loudspeaker 704 mounted on the dynamic diaphragm 701. The electrostatic loudspeaker 704 consists of four segments 704*a*, 704*b*, 704*c*, 704*d* and may be an electrostatic foil such as described with regard to FIGS. 6*a* and/or 6*b*. The detail view 710 shows this structure as a lateral cut. Here it is visible that each segment 704*a*, 704*b*, 704*c*, or 704*d* can work as a single electrostatic loudspeaker.

Figure 7C:
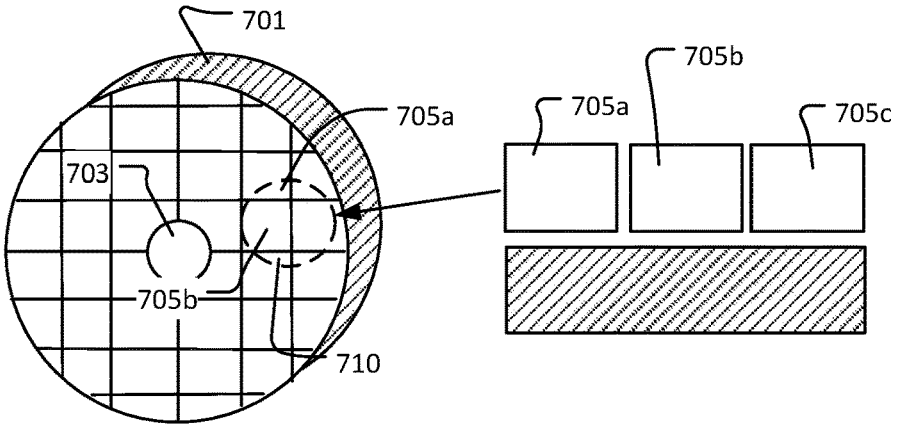

FIG. 7*c* shows a dynamic diaphragm 701 with a dust cap 703 and an electrostatic loudspeaker 705 mounted on the dynamic diaphragm 701. The electrostatic loudspeaker 705 consists of many segment 705*a*, 705*b*, 705*c*, etc. and may be an electrostatic foil such as described with regard to FIGS. 6*a* and/or 6*b*. The detail 710 shows this structure as a lateral cut. Here it is visible that each segment 705*a*, 705*b*, 705*c*, . . . can work as a single electrostatic loudspeaker.

It should be mentioned that the electrostatic loudspeaker could also be comprised by two, three or another number of segments not explicitly shown in FIGS. 7*a, b*, or *c*.

The segmentation of the electrostatic loudspeaker or the structure of many electrostatic loudspeakers working as one large electrostatic loudspeaker allows a better fitting and more cost-efficient coverage of the dynamic diaphragm with the electrostatic loudspeaker.

Driving the Loudspeaker to Perform Modal Correction of Loudspeaker Membranes

As already mentioned above, the electrostatic loudspeaker has a good performance for high frequencies, while it may suffer a degraded performance and an unavoidable clangor sound for deeper frequencies. Therefore it is beneficial to drive at least the electrostatic frequencies with a crossover network, such that only those frequencies reach the electrostatic loudspeaker that improve the dynamic loudspeaker's performance.

Figure 8:
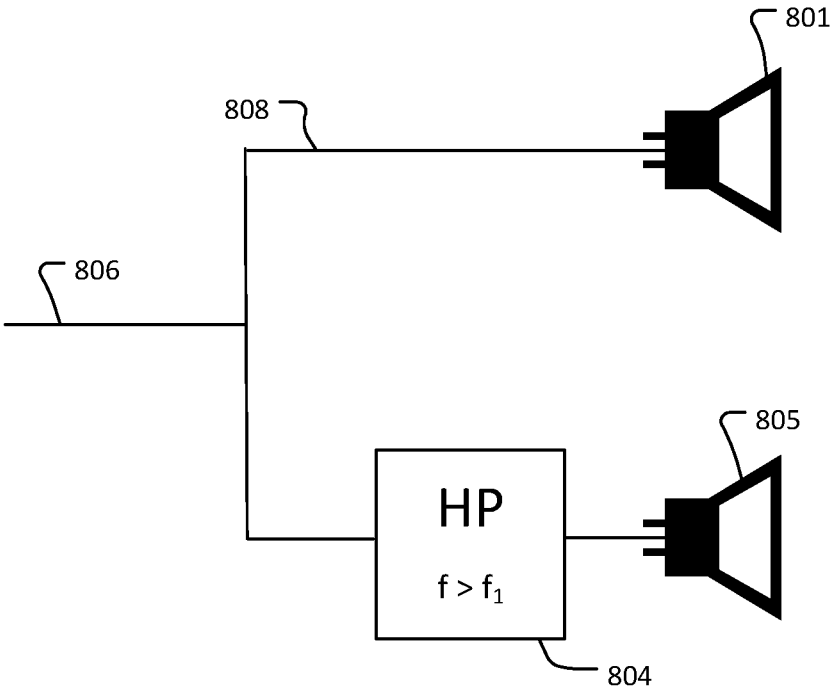
FIG. 8 shows an embodiment of driving the electrostatic loudspeaker via a high-pass filter upstream the electrostatic loudspeaker.

FIG. 8 shows an embodiment of driving the electrostatic loudspeaker via a high-pass filter upstream the electrostatic loudspeaker. In this embodiment, only one filter is used. The sound signal is received via the signal line 806 and is split. The complete and unfiltered signal reaches the dynamic loudspeaker 801 via the signal line 808, while a high-pass filter 804 is upstream the electrostatic loudspeaker 805. This high-pass filter 804 has a cutoff frequency that is equal or similar to the frequency of the first mode of the natural frequency $f_1$ (see also FIG. 2). The high-pass filter 804 ensures that only frequencies higher than $f_1$ reach the electrostatic loudspeaker. This compensates the degraded performance of the electrostatic loudspeaker at high frequencies by emphasizing high frequencies.

Figure 9:
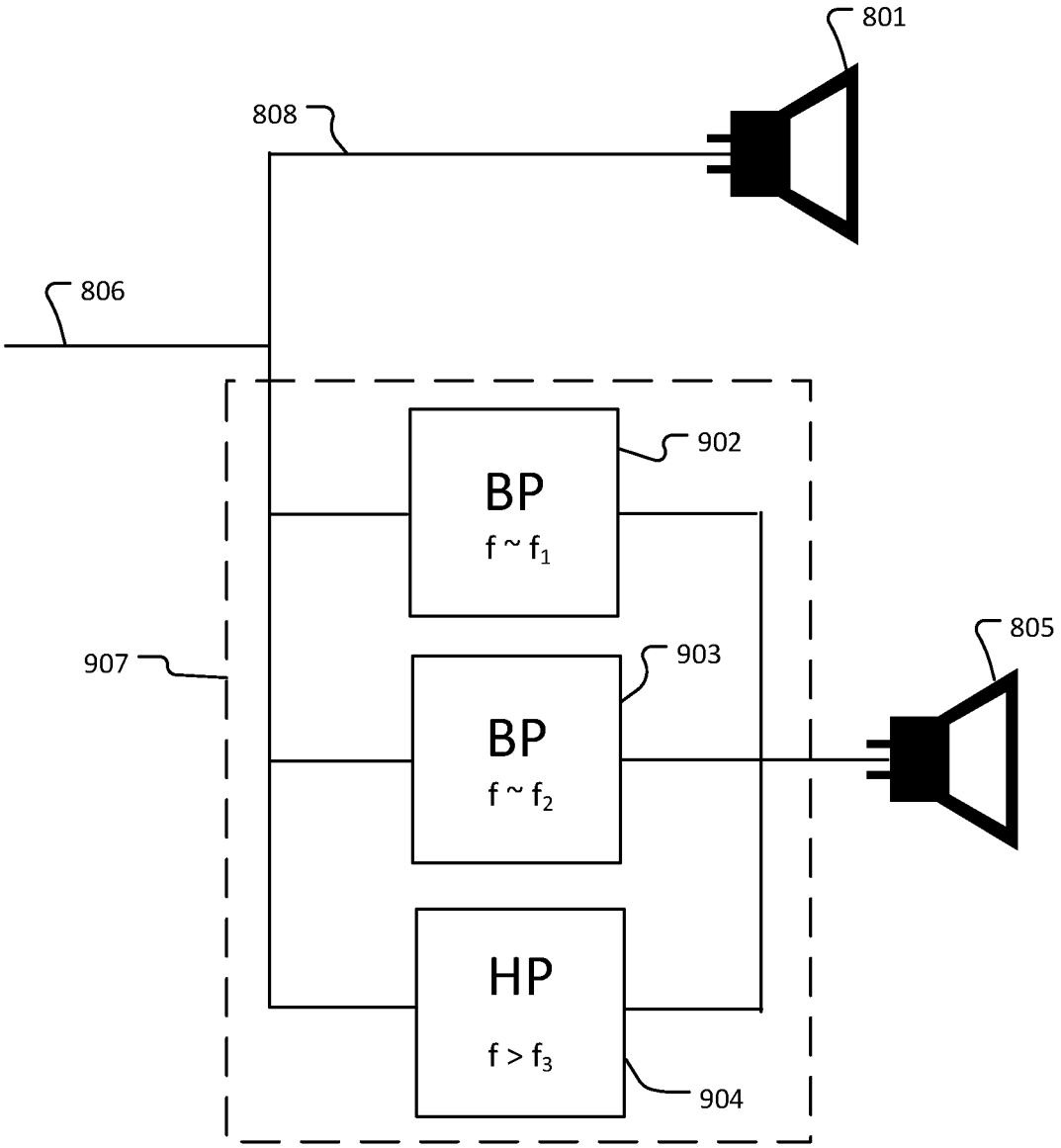
FIG. 9 shows another embodiment of driving the electrostatic loudspeaker via a frequency-separating filter comprising two band-pass filters and one high-pass filter.

FIG. 9 shows another embodiment of driving the electrostatic loudspeaker via a frequency-separating filter comprising two band-pass filters and one high-pass filter. In this embodiment, the sound signal is received via the signal line 806 and is split. The complete and unfiltered signal reaches the dynamic loudspeaker 801 via the signal line 808, while a frequency-separating filter 907 is placed upstream the electrostatic loudspeaker 805. The frequency-separating filter consists of a band pass filter 902, that passes only frequencies around the first mode of the natural frequency $f_1$, a band pass filter 903, that passes only frequencies around the second mode of the natural frequency $f_2$, and a high-pass filter 904 that passes only frequencies above the third mode of the natural frequency $f_3$. This structure has the advantage of only emphasizing those frequencies that suffer a volume loss due to partial oscillations, as described earlier with regard to FIGS. 2 and 3.

Figure 10A:
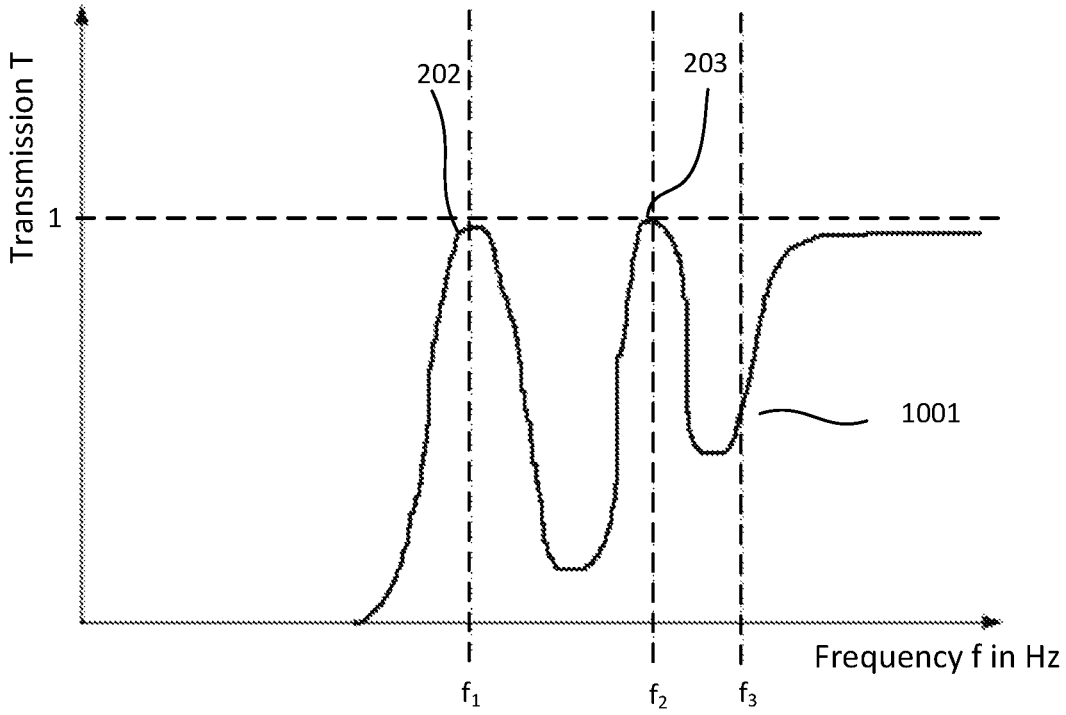
FIG. 10*a* shows the transmission of the frequency-separating filter described in FIG. 9.

FIG. 10*a* shows the transmission of the frequency-separating filter described in FIG. 9. The Transmission profile T(f) of the frequency-separating filter 907 is designed in such a way that it has its maxima at the positions where the sound radiation power P(f) (see FIGS. 2 and 10*b*) has its minima 202, 203. For higher frequencies 204, the transmission T(f) becomes basically constant and close to one.

Figure 10B:
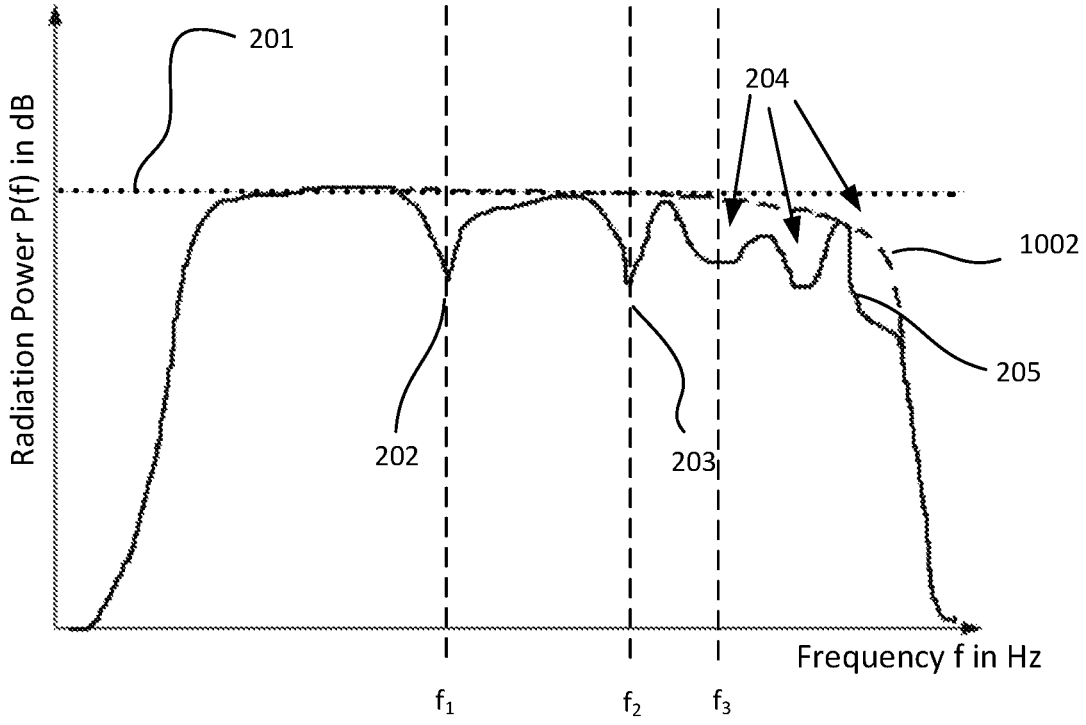
FIG. 10*b* visualizes (in an idealistic example) the sound radiation power P(f) of a dynamic loudspeaker with modal correction of the loudspeaker membrane.

FIG. 10*b* visualizes (in an idealistic example) the sound radiation power P(f) of a dynamic loudspeaker with modal correction of the loudspeaker membrane. The diagram comprises all elements of FIG. 2 and the resulting P(f)-profile 1002. As mentioned above, the transmission of the frequency-separating filter 907 supports those frequencies where the sound radiation power P(f) of the dynamic loudspeaker has its minima. This overcomes or at least partially overcomes the volume loss due to destructive interference near modes of the natural frequency of the loudspeakers diaphragm.

It should be mentioned, that other frequency-separating filters are possible. For example, additional filters such as band-pass filters can be added by the skilled person, so that the embodiments are not limited to the specific frequency-separating filters described in FIGS. 8 and 9.

Additionally, the embodiments for structure of the diaphragms as shown in FIG. 6 and the segments shown in FIG. 7 can be combined.

Two-Way System (HF Distribution)

The loudspeaker system described above may be used to create a two-way loudspeaker by usage of the electrostatic foil (108 in FIGS. 6*a, b*) layered on the dynamic loudspeaker system. According to this embodiment, the dynamic loudspeaker by means of the magnetically driven diaphragm (101 in FIGS. 6*a*, 6*b*) provides the low and mid frequencies, whereas the electrostatic loudspeaker system by means of the electrostatic diaphragm (403 in FIGS. 6*a*, 6*b*) provides the high frequencies. Thus, the layered loudspeaker systems add up to one multi frequency system with uniaxial characteristics. A combination of both use cases (i.e. the correction function and the HF distribution) can be applied.

Measurement and Analysis of the Capacity of the Electrostatic Layer

By measurement of the capacity of the electrostatic foil (e.g. electrostatic diaphragm 403 in FIGS. 6*a*, 6*b*), the deformation of the dynamic membrane (101 in FIGS. 6*a*, 6*b*) can be analysed. Thus, parameters for the correction function may be derived. For example, a sectional, concentric division of the layer (ring membranes) can be used to derive multiple, dedicated information of each ring zone of the dynamic membrane. This may give detailed information about the dynamic membrane deformation regarding its sectional distortion. A correction process to optimize the membrane movement can be derived. This way, expensive measurements e.g. by laser-interferometry can be partially avoided, and a recalibration of the device to aging effects that change the properties of the dynamic membrane can be achieved due to in-situ measurements.

Aspects of the above described technology are also the following:

[1] A loudspeaker system comprising a diaphragm (101) and an electrostatic foil (108) mounted on top of the diaphragm (101).

[2] The loudspeaker system of [1], wherein the electrostatic foil (108) is configured to emphasize predefined frequencies or frequency ranges where modal resonances of the diaphragm (101) occur.

[3] The loudspeaker system of [1] or [2], wherein the electrostatic foil (108) acts as an electrostatic loudspeaker.

[4] The loudspeaker system of anyone of [1] to [3], wherein the electrostatic foil (108) comprises a stator (401) that is mounted on the diaphragm (101) and an electrostatic diaphragm (403) that is mounted above the stator (401) with a gap between the stator (401) and the electrostatic diaphragm (403).

[5] The loudspeaker of anyone of [1] to [3], wherein the electrostatic foil (108) comprises an electrostatic diaphragm (403) mounted above the diaphragm (101) with a gap between the diaphragm (101) and the electrostatic diaphragm (403), and wherein the diaphragm (101) is a conductive diaphragm that is used as a stator of an electrostatic loudspeaker.

[6] The loudspeaker system of anyone of [1] to [5], wherein the electrostatic foil (108) mounted on the diaphragm (101) is separated into a plurality of individual segments.

[7] The loudspeaker system of [6], wherein each segment of the electrostatic foil (108) is configured as an electrostatic loudspeaker that is driven individually.

[8] The loudspeaker system of anyone of [1] to [7], further comprising a controlling device (402) configured to drive the electrostatic foil, the controlling device (402) comprising a frequency-shaping filter.

[9] The loudspeaker system of [8], wherein the frequency-shaping filter comprises a high-pass filter, the high-pass filter having a cutoff frequency related to a mode of the natural frequency of the diaphragm (101).

[10] The loudspeaker system of [8] or [9], wherein the frequency-shaping filter comprises one or more band-pass filters having a central frequency around a respective mode of the natural frequency of the diaphragm (101).

[11] The loudspeaker system of anyone of [1] to [10], wherein the loudspeaker system is used as a two-way loudspeaker.

[12] The loudspeaker system of anyone of [1] to [11], wherein a measurement and analysis of the capacity of the electrostatic foil (108) is performed.

[13] The loudspeaker system of anyone of [1] to [12], wherein the diaphragm (101) is magnetically driven according to the principle of a dynamic loudspeaker.

[14] The loudspeaker system of anyone of [1] to [13], wherein the diaphragm (101) is a diaphragm (101) of a dynamic loudspeaker, and in which the dynamic loudspeaker comprises at least one of the following: a loudspeaker basket (100), a dust cap (102), a spider (103), a permanent magnet (104), a bottom plate (105), a voice coil (107) and a surround (108).

[15] The loudspeaker system of anyone of [1] to [14], further comprising means for measuring the capacity of the electrostatic foil.

LIST OF REFERENCE SIGNS

100 loudspeaker basket
101 diaphragm
102 dust cap
103 spider (suspension)
104 permanent magnet
105 bottom plate
106 voice coil

107 surround
108 electrostatic loudspeaker
201 ideal line for sound radiation power P(f)
202 minimum of P(f) at $f=f_1$
203 minimum of P(f) at $f=f_2$
204 group of minima of P(f) at $f \geq f_3$
205 course of P(f) for a real dynamic loudspeaker
301 diaphragm's peak
302 negative deflection of the diaphragm
401 stator
402 controlling device
403 electrostatic diaphragm
404 signal line
405 electrical contact
406 electrical contact
701 diaphragm of dynamic loudspeaker
702 electrostatic loudspeaker
703 dust cap
704 segmented electrostatic loudspeaker
705 segmented electrostatic loudspeaker
710 lateral cut of the marked section
801 dynamic loudspeaker
804 high-pass filter $f>f_1$
805 electrostatic loudspeaker
806 signal line
808 signal line to the dynamic loudspeaker
902 band-pass filter $f \sim f_1$
903 band-pass filter $f \sim f_2$
904 high-pass filter $f>f_3$
907 frequency-separating filter
1001 Transmission profile T(f)
1002 course of P(f) for loudspeaker

The invention claimed is:

1. A loudspeaker system comprising a diaphragm of a dynamic loudspeaker and an electrostatic foil mounted on top of the diaphragm, wherein the diaphragm is formed of a single and unbroken sheet of material, such that the entire diaphragm is capable of resonating as a single dynamic loudspeaker, and wherein the electrostatic foil is separated into a plurality of segments on the diaphragm, and each segment of the plurality of segments is capable of working as a single electrostatic loudspeaker.

2. The loudspeaker system of claim 1, wherein the electrostatic foil is configured to emphasize predefined frequencies or frequency ranges where modal resonances of the diaphragm occur.

3. The loudspeaker system of claim 1, wherein the electrostatic foil comprises a stator that is mounted on the diaphragm and an electrostatic diaphragm that is mounted above the stator with a gap between the stator and the electrostatic diaphragm.

4. The loudspeaker of claim 1, wherein the electrostatic foil comprises an electrostatic diaphragm mounted above the diaphragm with a gap between the diaphragm and the electrostatic diaphragm, and wherein the diaphragm is a conductive diaphragm that is used as a stator of the electrostatic loudspeakers.

5. The loudspeaker system of claim 1, wherein each segment of the electrostatic foil is configured as an electrostatic loudspeaker that is driven individually.

6. The loudspeaker system of claim 1, further comprising a controlling device configured to drive the electrostatic foil, the controlling device comprising a frequency-shaping filter.

7. The loudspeaker system of claim 6, wherein the frequency-shaping filter comprises a high-pass filter, the high-pass filter having a cutoff frequency related to a mode of the natural frequency of the diaphragm.

8. The loudspeaker system of claim 6, wherein the frequency-shaping filter comprises one or more band-pass filters having a central frequency around a respective mode of the natural frequency of the diaphragm.

9. The loudspeaker system of claim 6, wherein the loudspeaker system is used as a two-way loudspeaker.

10. The loudspeaker system of claim 1, wherein a measurement and analysis of the capacity of the electrostatic foil is performed.

11. The loudspeaker system of claim 1, wherein the diaphragm is magnetically driven according to the principle of a dynamic loudspeaker.

12. The loudspeaker system of claim 1, wherein the dynamic loudspeaker comprises at least one of the following: a loudspeaker basket, a dust cap, a spider, a permanent magnet, a bottom plate, a voice coil and a surround.

13. The loudspeaker system of claim 1, further comprising means for measuring the capacity of the electrostatic foil.

14. The loudspeaker system of claim 3, wherein the electrostatic diaphragm comprises a plastic sheet coated with a conductive material.

15. The loudspeaker system of claim 1, wherein the plurality of segments of the electrostatic foil on the diaphragm are not formed using a rigid structure.

* * * * *